US005433641A

United States Patent [19]

Rudell et al.

[11] Patent Number: 5,433,641

[45] Date of Patent: Jul. 18, 1995

[54] TOY VEHICLE LAUNCHER WITH PIVOTING LINEAR PROPULSION MEMBERS

[76] Inventors: Elliot Rudell, 1619 Gramercy Ave., Torrance, Calif. 90501; George Foster, 2700 Panorama Dr. #404, Signal Hill, Calif. 90806

[21] Appl. No.: 182,583

[22] Filed: Jan. 18, 1994

[51] Int. Cl.[6] ..... A63H 29/00; A63H 27/14

[52] U.S. Cl. ..... 446/28; 446/63; 446/429; 124/79

[58] Field of Search ..... 446/429, 430, 228, 63-65, 446/489, 490, 26, 28; 124/79, 1; 273/327, 330, 413, 414, 129 R; 482/92

[56] References Cited

U.S. PATENT DOCUMENTS

| | | | |
|---|---|---|---|
| 1,975,724 | 10/1934 | Jonas | 273/327 |
| 2,690,339 | 9/1954 | Hall | 273/327 |
| 3,641,704 | 2/1972 | Sims et al. . | |
| 3,797,164 | 3/1974 | Glass et al. . | |
| 3,918,197 | 11/1975 | Stanzel | 446/65 |
| 3,952,442 | 4/1976 | Livesey et al. | 446/429 |
| 4,005,543 | 2/1977 | McKay | 446/65 |
| 4,080,750 | 3/1978 | Palumbo | 446/228 |
| 4,472,906 | 9/1984 | Cook et al. | 446/429 |
| 4,513,967 | 4/1985 | Halford et al. | 273/108 |
| 4,690,658 | 9/1987 | Crosson et al. | 446/429 |
| 5,052,973 | 10/1991 | Rudell et al. | 446/429 |

FOREIGN PATENT DOCUMENTS

| | | | |
|---|---|---|---|
| 2113560 | 8/1983 | United Kingdom | 446/429 |

*Primary Examiner*—Mickey Yu

*Attorney, Agent, or Firm*—Blakely, Sokoloff, Taylor & Zafman

[57] ABSTRACT

A toy vehicle launcher which has a vehicle that can slide along a track. The launcher includes a string which extends along each side of a longitudinal axis of the track. The string is attached to a pair of handles which can be pulled so that the string engages the vehicle and propels the same along the track. Both the track and vehicle have corresponding T shaped features which capture and maintain the vehicle on the track.

16 Claims, 5 Drawing Sheets

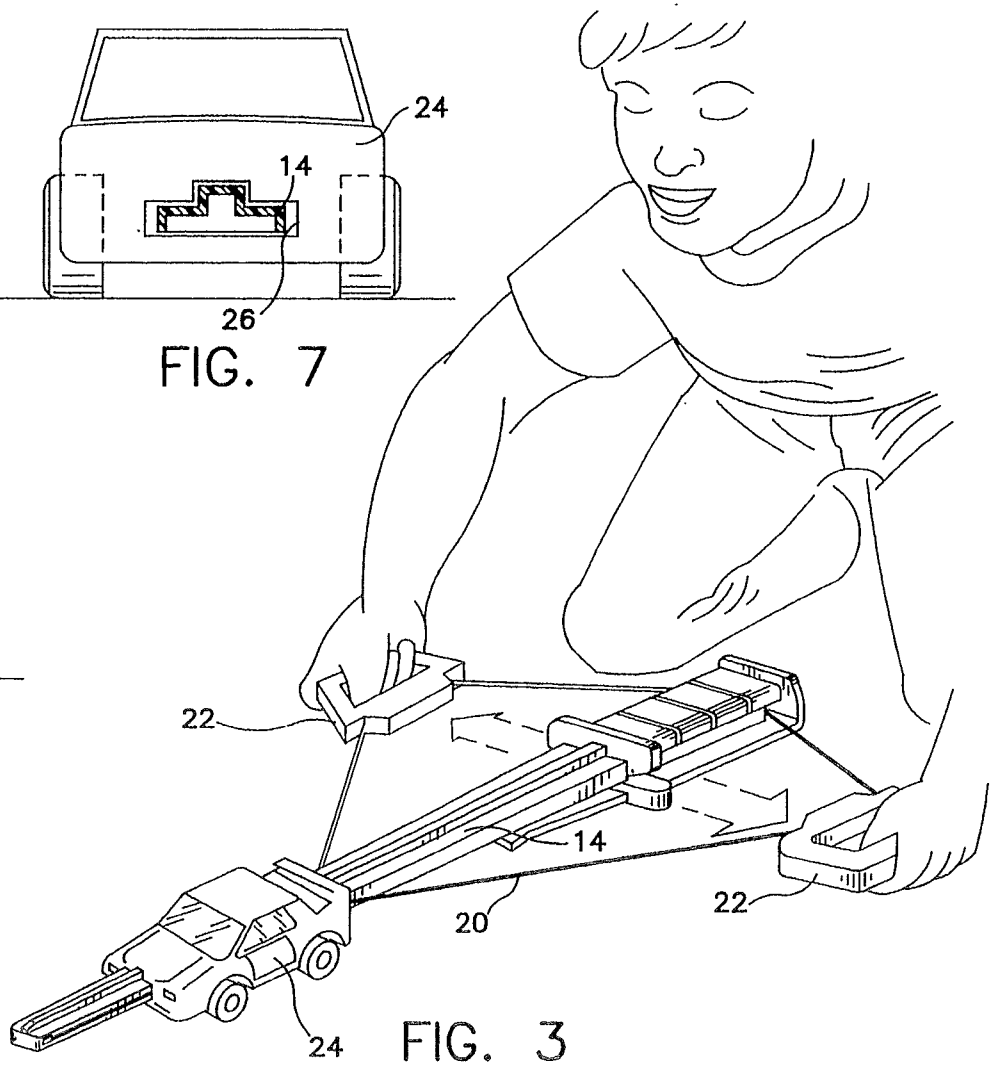
FIG. 3
FIG. 7
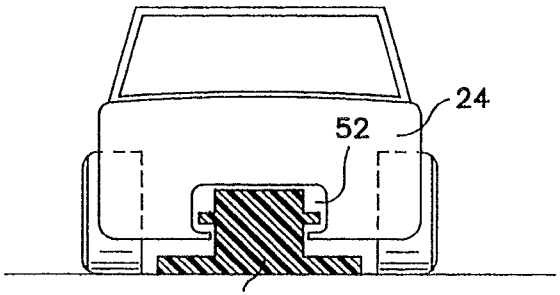
FIG. 8

TOY VEHICLE LAUNCHER WITH PIVOTING LINEAR PROPULSION MEMBERS

BACKGROUND OF THE INVENTION

1. Field of the Invention

The present invention relates to a toy vehicle launcher.

2. Description of Related Art

Toy vehicles have been a source of amusement for many years. Children particularly enjoy toy vehicles that can move across a floor. To more simulate a real vehicle, some toy vehicles include an electric or gas motor which propels the toy. Electric motors require batteries and can only attain a limited speed. Gas powered motors are loud and require continual refueling. Both electric and gas motors are also susceptible to breakdown and repair.

U.S. Pat. No. 5,052,973 issued to Rudell et al.; U.S. Pat. No. 4,472,906 issued Cook et al.; U.S. Pat. No. 3,641,704 issued to Sims et al.; U.S. Pat. No. 4,513,967 issued to Halford et al.; U.S. Pat. No. 3,797,164 issued to Glass et al.; U.S. Pat. No. 4,690,658 issued to Crosson et al. and U.S. Pat. No. 3,952,442 issued to Livesey et al., all disclose toy vehicle launchers which have a sled, a slide, a ramp or another similar type of component that pushes and propels a vehicle across a floor. Some of the launchers disclosed in the above cited patents can propel the car only a limited distance, thereby reducing the effectiveness of the device. Additionally, prior toy launchers can also be used to project harmful objects such as a paper clip or a BB at another child. This additional function reduces the safety and consumer value of the toy. It would be desirable to provide a toy vehicle launcher which is both safe and can project the vehicle a significant distance.

SUMMARY OF THE INVENTION

The present invention is a toy vehicle launcher that can propel a vehicle across a surface. The launcher includes a string that extends along each side of a track. The string is attached to a pair of handles which can be pulled so that the string engages and propels the vehicle down the track. Both the track and vehicle have corresponding T shaped features which capture and maintain the vehicle on the track when the string and handles are pulled by the operator.

BRIEF DESCRIPTION OF THE DRAWINGS

The objects and advantages of the present invention will become more readily apparent to those ordinarily skilled in the art after reviewing the following detailed description and accompanying drawings, wherein:

FIG. 3 is a perspective view showing a user operating the toy vehicle launcher;

FIG. 7 is a cross-sectional view showing the track extending through an opening in the vehicle;

FIG. 8 is a cross-sectional view showing an alternate track and vehicle opening configuration;

DETAILED DESCRIPTION OF THE INVENTION

Figure 1:
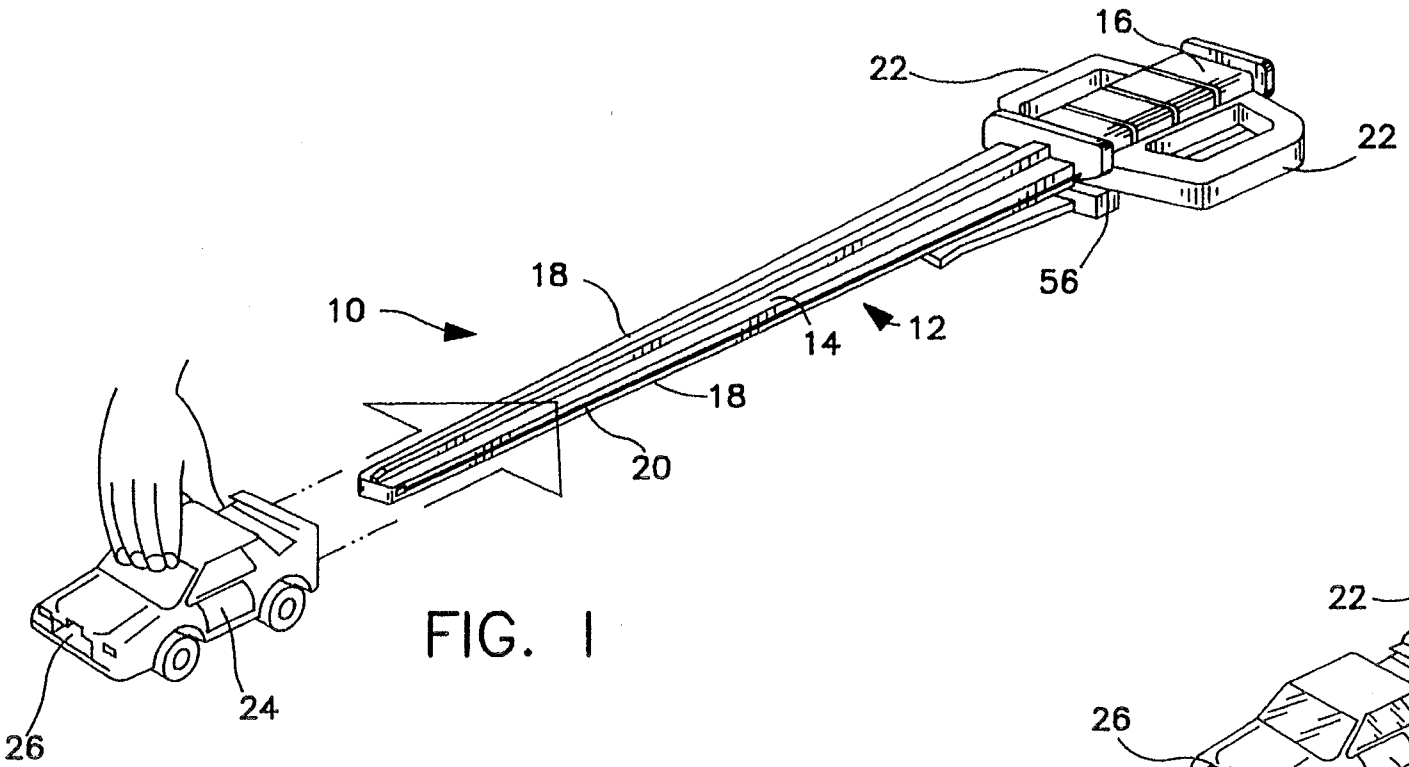
FIG. 1 is a perspective view showing a vehicle being loaded onto a track.

Referring to the drawings more particularly by reference numbers, FIGS. 1–4 show the loading and operation of a toy vehicle launcher set 10 of the present invention. The toy 10 includes a launcher 12 which has a track 14 that extends from a handle section 16. The track 14 has a pair of opposite sides 18 that extend along a longitudinal axis of the launcher 12. Adjacent to each side of the track 14 is a string 20. The string 20 is attached to a pair of handles 22 that are adjacent to the handle section 16 of the launcher 12.

Figure 2:
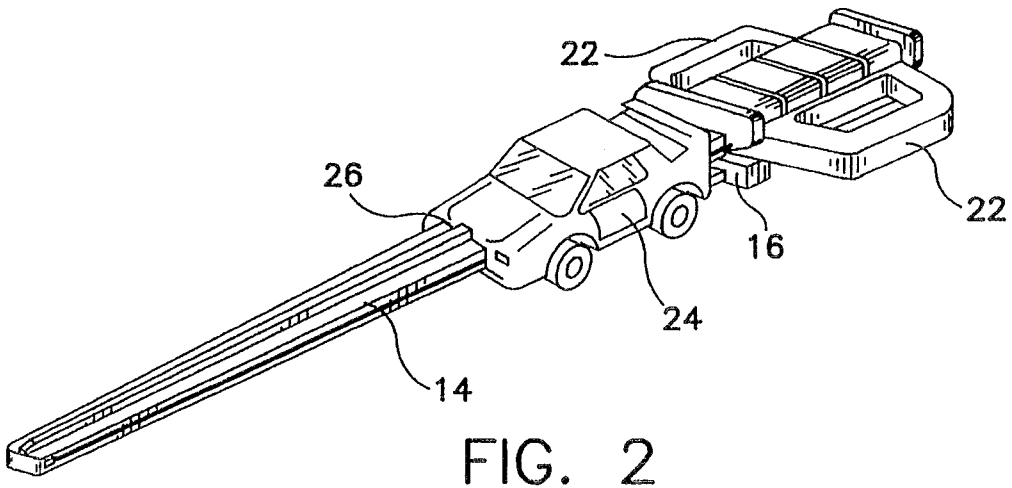
FIG. 2 is a perspective view similar to FIG. 1 showing the vehicle loaded onto the track.
Figure 4:
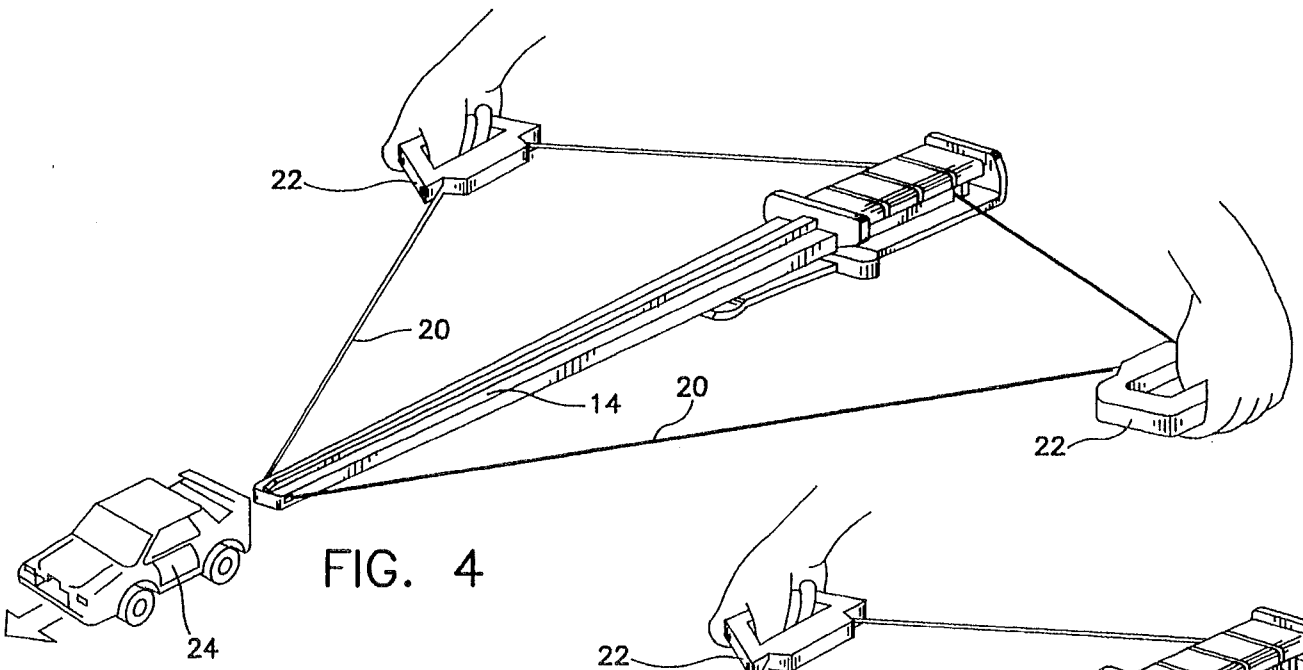
FIG. 4 is a perspective view showing the vehicle being projected by the toy launcher.

The toy set 10 includes a vehicle 24 which has an inner opening 26 that corresponds to the cross-section of the track 14. The opening 26 and track cross-section 14 capture the vehicle 24 and prevent any lateral vehicle movement when the vehicle is propelled down the track. As shown in FIGS. 1 and 2, the launcher 12 is loaded by pushing the vehicle 24 so that track 14 slides through the opening 26. The vehicle 24 is preferably pushed until it is flush with the handle section 16 of the launcher 12.

As shown in FIG. 3, to launch the vehicle 24, the user pulls the handles 22 away from the sides of the track 14. Pulling the handles 22 causes the string 20 to engage and propel the vehicle 24. The movement of the string 20 has components that are both perpendicular and parallel with the longitudinal axis of the track 114. The parallel component of the string pushes the vehicle 24 along the track 14. The interaction of the opening 26 and the track cross-section prevent vehicle lateral movement and insure that the momentum of the vehicle is essentially parallel with the longitudinal axis of the track.

Figure 5:
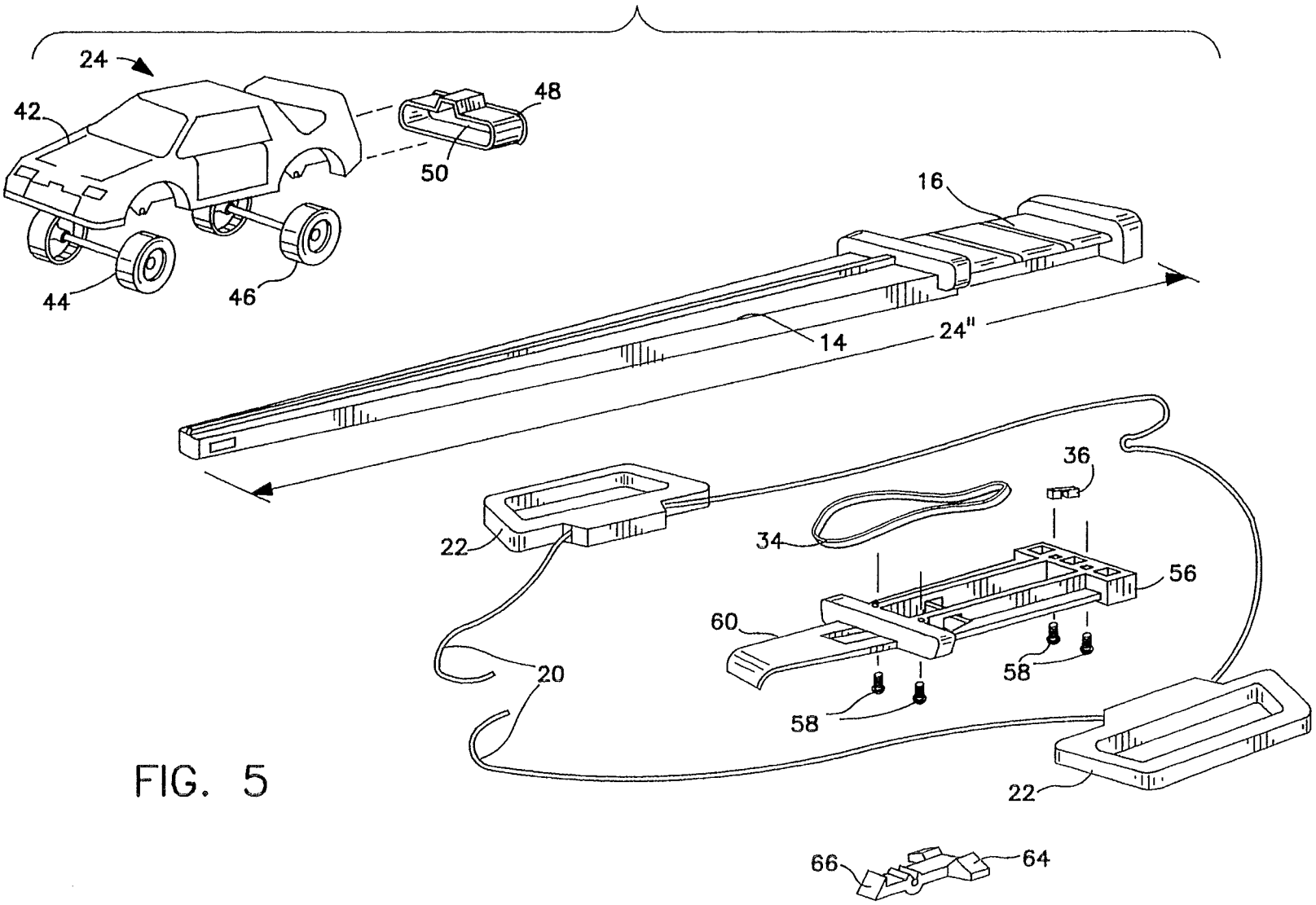
FIG. 5 is an exploded view of the toy vehicle launcher.
Figure 6:
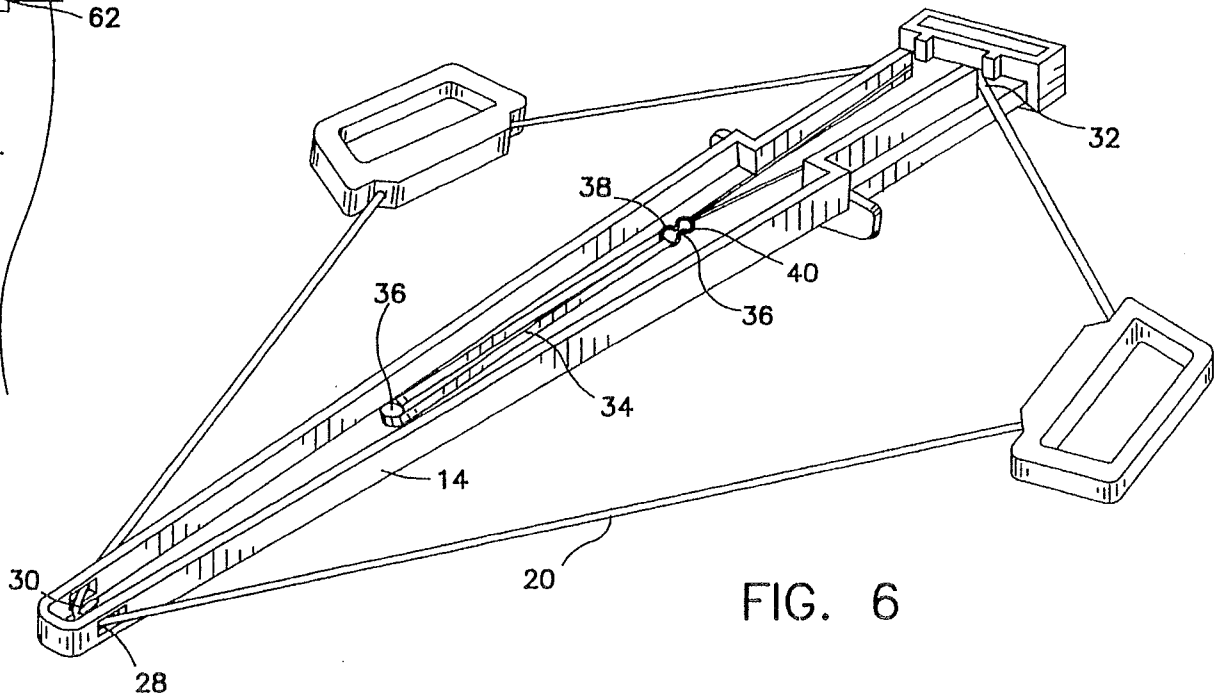
FIG. 6 is a bottom perspective view of the launcher.

FIGS. 5–7 show a preferred embodiment of the toy vehicle launcher 10 of the present invention. As shown in FIG. 6, the string 20 is preferably constructed from one piece that extends through holes 28 in the track and is tied together at ends 30. The string 20 is rigidly attached to the handles 22 so that the handles 22 do not slide relative to the string 20. Relative movement between the string 20 and handles 22 may reduce the amount of displacement by the string 20 when the handles 22 are pulled.

The string 20 extends through slots 32 formed in the launcher 12 and is coupled to a spring 34 by clip 36. The spring 34 is preferably a rubber band that is wrapped around a knob 36 at one end, and a hook 38 in the clip 36 on the opposite end. The string 20 is also wrapped around clip hook 40. The spring 34 biases the string 20 toward the track 14, and returns the string 20 and handles 22 to the original positions after the handles 22 have been released by the user.

Referring to FIG. 5, the vehicle 24 may have a body 42 which simulates an automobile. Attached to the body 42 are a pair of front wheels 44 and a pair of rear wheels 46. The rear wheels 46 are preferably constructed from rubber or another material which will provide sufficient traction to propel the vehicle 24. The front wheels 44 are preferably constructed from a hard plastic which creates a minimal amount of friction so that the vehicle 24 travels in essentially a straight line. The body 42 is preferably constructed from a light durable plastic such as a high impact styrene, polyethylene or polypropylene. The track 14 is also preferably constructed from a high impact plastic material.

The vehicle 24 has an insert 48 with an opening 50 that corresponds to the cross-section of the track 14. The insert 48 is typically the portion of the vehicle 24 which engages the string 20 and therefore is preferably constructed from a hard, durable, low-friction material such as an acetyl plastic commonly sold as DELRIN.

As shown in FIG. 7, both the track cross-section and the openings 26 and 50 are T shaped, so that the vehicle 24 is captured by the track 14. The T shaped track and openings prevent any other object that does not have the same corresponding pattern to be projected by the launcher. This feature significantly improves the safety of the product. Although a T shaped track and openings are shown and described, it is to be understood that other configurations can be used, including a circular shaped track. A circular shaped track would allow the vehicle to rotate about the track if the toy is lifted into the air. The circular track would thus make it difficult to launch the vehicle from the air.

FIG. 8 shows an alternate embodiment wherein the vehicle body 42 has an opening 52 that allows a t shaped track 54 to extend therethrough. The embodiment of FIG. 8 insures that the wheels of the vehicle are in contact with the floor when the vehicle is propelled down the track. Providing wheel/floor contact may increase the stability and accuracy of the vehicle as it propelled from the launcher.

Referring to FIG. 5, the launcher 12 may have a bottom section 56 that is attached to the handle section 16 by screws 58. As shown in FIG. 1, the bottom section 56 separates the track 14 from the floor so that the vehicle 24 can slide down the launcher 12. The track 14 may be separated from the floor, so that either the body 42 of the vehicle 24 slides along the track 14, or the wheels make contact with the ground when the vehicle travels down the track.

Figure 9:
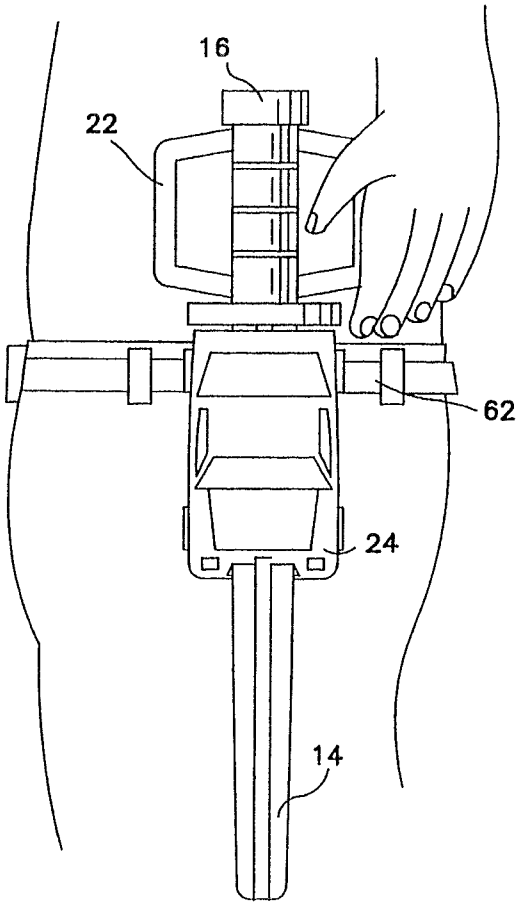
FIG. 9 is a perspective view showing the toy vehicle launcher attached to the belt of a user.

Referring to FIGS. 5 and 9, the bottom section 56 may have a clip 60 that is separated from the track 14 by a groove (not shown) which may receive a belt 62 of the user. The clip 60 allows the user to wear and carry the toy. The launcher may also have a vehicle lock tab 64 attached to the bottom section 56. The lock 64 has a tab 66 which can hook onto a wheel axle and secure the vehicle in place when the user is wearing the toy, as shown in FIG. 9.

Figure 10:
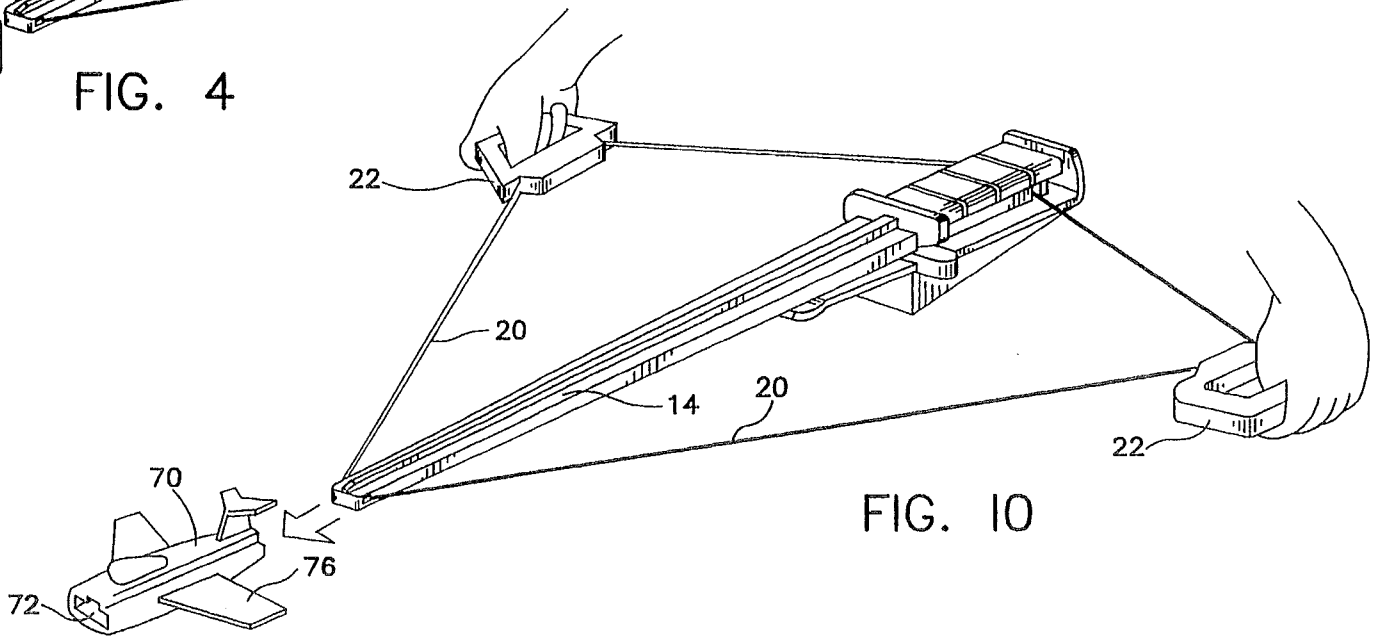
FIG. 10 is a perspective view showing the toy launcher propelling a toy airplane.

FIG. 10 shows an alternate embodiment wherein the vehicle is constructed as an airplane 70 with openings 72 that correspond to the cross-section of the track 14. The launcher may have a tapered bottom section 74 which tilts the track 14 in an upward direction. The airplane can be loaded on the launcher and propelled from the track 14 by pulling the handles 22 and moving the string 20. The wings 76 of the airplane 70 may be constructed so that the forward thrust of the vehicle generates lift and causes the plane to fly. Although a vehicle constructed to simulate an automobile or airplane are described and shown, it is to be understood that the vehicle can be constructed to simulate other items such as a motorcycle, or a rocket.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A toy vehicle launcher, comprising:
a rigid track;
a vehicle that can move along said track;
a string that extends along said track and which can engage said vehicle;
handle means for pulling said string away from said track such that said string engages and propels said vehicle down and away from said track so that said vehicle is released from said track; and,
a spring that is coupled to said string and which biases said string toward said track.

2. The toy vehicle launcher as recited in claim 1, wherein said handle means includes a pair of handles attached to said string.

3. The toy vehicle launcher as recited in claim 1, wherein said vehicle has an inner opening which receives a corresponding track section.

4. The toy vehicle launcher as recited in claim 1, further comprising a clip that couples said string to said spring.

5. The toy vehicle launcher as recited in claim 1, wherein said vehicle is constructed as an automobile.

6. The toy vehicle launcher as recited in claim 1, wherein said vehicle is constructed as an airplane.

7. The toy vehicle launcher as recited in claim 6, wherein said track has a tapered ramp section.

8. The toy vehicle launcher as recited in claim 1, wherein said track has a clip that allows said track to be attached to a belt.

9. The toy vehicle launcher as recited in claim 8, wherein said track has a lock tab which can secure said vehicle to said track.

10. A toy vehicle launcher, comprising:
a track that has opposite sides extending along a longitudinal axis of said track, said track further having a T shaped section;
a vehicle that can move along said track, said vehicle having a T shaped opening which can receive said T shaped section;
a string that extends along each side of said track and which can engage said vehicle;
a pair of handles attached to said string and which can be pulled away from said track such that said string engages and propels said vehicle down said track; and,
a spring coupled to said string, that biases said string toward said track.

11. The toy vehicle launcher as recited in claim 10, further comprising a clip that couples said string to said spring.

12. The toy vehicle launcher as recited in claim 10, wherein said vehicle is constructed as an automobile.

13. The toy vehicle launcher as recited in claim 10, wherein said vehicle is constructed as an airplane.

14. The toy vehicle launcher as recited in claim 13, wherein said track has a tapered ramp section.

15. The toy vehicle launcher as recited in claim 10, wherein said track has a clip that allows said track to be attached to a belt.

16. The toy vehicle launcher as recited in claim 15, wherein said track has a lock tab which can secure said vehicle to said track.

* * * * *